US011603297B1

(12) United States Patent
Chen

(10) Patent No.: US 11,603,297 B1
(45) Date of Patent: Mar. 14, 2023

(54) LIFT JACK

(71) Applicant: YUN KUAN ENTERPRISE CO.,LTD., Tongluo Township, Miaoli County (TW)

(72) Inventor: Wen-Che Chen, Tongluo Township, Miaoli County (TW)

(73) Assignee: YUN KUAN ENTERPRISE CO., LTD., Miaoli County (TW)

( * ) Notice: Subject to any disclaimer, the term of this patent is extended or adjusted under 35 U.S.C. 154(b) by 0 days.

(21) Appl. No.: 17/551,155

(22) Filed: Dec. 14, 2021

(51) Int. Cl.
*B66F 3/42* (2006.01)
*B66F 5/04* (2006.01)
*B66F 3/26* (2006.01)

(52) U.S. Cl.
CPC ..... *B66F 3/42* (2013.01); *B66F 3/26* (2013.01); *B66F 5/04* (2013.01)

(58) Field of Classification Search
CPC ..... B66F 1/00; B66F 3/00; B66F 1/02; B66F 1/06; B66F 3/25; B66F 3/42; B66F 3/26; B66F 5/04
See application file for complete search history.

(56) References Cited

U.S. PATENT DOCUMENTS 388,156 A * 8/1888 Strom ..... B66F 1/02 254/106
4,084,792 A * 4/1978 Baron ..... B66F 1/02 254/106
5,622,355 A * 4/1997 Kopp ..... B66F 1/02 254/133 A
2010/0237105 A1* 9/2010 Zagone ..... B05C 17/0126 222/391

FOREIGN PATENT DOCUMENTS

CN 209615234 U * 11/2019
DE 202012004735 U1 * 9/2012 ..... B25B 27/0035
WO WO-2020209731 A1 * 10/2020 ..... B05C 17/0052

OTHER PUBLICATIONS

DE202012004735U1 (Tsai Bing Hsiu) published on Jul. 24, 2012 Translation retrieved from Google Patents (https://patents.google.com/patent/DE202012004735U1/en?oq=DE202012004735U1+) (Year: 2012).*

CN209615234U (李跃明朱勇巍) published on Nov. 12, 2019 Translation retrieved from Google Patents (https://patents.google.com/patent/CN209615234U/en?oq=CN-209615234-U) (Year: 2019).*

* cited by examiner

*Primary Examiner* — Joseph J Hail
*Assistant Examiner* — Christopher Soto

(57) ABSTRACT

A clamp contains: a body, an actuation rod, and a slow descending device. The body includes a first support sheet, and the actuation rod includes a second support sheet. The body further includes a drive grip, a driven mechanism, and a limitation mechanism. The limitation mechanism has a first spring, multiple first fixing protrusions, and a release lever. The slow descending device includes a second spring, multiple second fixing protrusions, a guide element, and a micro-adjustment handle. The micro-adjustment handle has a pull lever and the second spring 31 surrounds around the actuation ro. The multiple second fixing protrusions accommodate the actuation rod and are pushed by the second spring. The micro-adjustment handle has a third spring and a control lever pushed by the third spring and contacting with the multiple second fixing protrusions.

2 Claims, 9 Drawing Sheets

LIFT JACK

FIELD OF THE INVENTION

The present invention relates to a lift jack which is capable of expanding outward, and the first support sheet and the second sheet are adjustable to retract to each other by pressing the drive grip repeatedly.

BACKGROUND OF THE INVENTION

A conventional clamp contains a movable part and fixed part opposite to at least one paw, wherein the movable part is fixed on an end of a guide rod which is slidably mounted on the fixed part. The fixed part includes two grips having two release sheets extending from two ends thereof, and a press handles rotatably connected with the fixed part. A drive sheet is configured to drive an clamp assembly in the fixed part, and the two press handles are configured to drive a limitation assembly, such that the two press handles are pressed repeatedly to move the movable part and the fixed part, thus clamping and unclamping an object.

The clamp is formed in a gun shape and further contains a slow actuation mechanism pressed repeatedly to drive the fixed part and the movable part to clamp and unclamp the object and to applicable for a lift jack.

However, when desiring to descend the lift jack slowly after the lift jack lifts the object, a user has to support the object and the lift jack manually, thus having troublesome operation.

The present invention has arisen to mitigate and/or obviate the afore-described disadvantages.

SUMMARY OF THE INVENTION

The primary aspect of the present invention is to provide a lift jack which is capable of expanding outward, and the first support sheet and the second sheet are adjustable to retract to each other by pressing the drive grip repeatedly.

To obtain the above mentioned aspects, a lift jack provided by the present invention contains: a body, an actuation rod, and a slow descending device.

The body includes a first support sheet disposed on an end thereof, and the actuation rod is movably inserted through the body and includes a second support sheet mounted on an end thereof and corresponding to the first support sheet. The body further includes a drive grip rotatably connected on a bottom thereof, a driven mechanism received in the body and controlled by the drive grip to expend the first support sheet and the second support sheet. The body further including a limitation mechanism accommodated therein and configured to fix the actuation rod after the actuation rod moves relative to the body.

The limitation mechanism has a first spring, multiple first fixing protrusions, and a release lever extending from an end of the multiple first fixing protrusions and configured to remove the actuation rod relative to the body.

The slow descending device includes a second spring, multiple second fixing protrusions, a guide element, and a micro-adjustment handle rotatably connected on the bottom of the body adjacent to the drive grip. The micro-adjustment handle has a pull lever which is inserted through and drives the release lever after being pressed, and the second spring 31 surrounds around the actuation rod, the multiple second fixing protrusions accommodate the actuation rod and are pushed by the second spring, and the actuation rod is also inserted through the guide element, A first end of the guide element is pushed by the first spring and a second end of the guide element abuts against the multiple fixing protrusions, the micro-adjustment handle has a third spring and a control lever pushed by the third spring and contacting with the multiple second fixing protrusions.

Preferably, a fourth spring is defined between the pull lever and the release lever.

DETAILED DESCRIPTION OF THE PREFERRED EMBODIMENTS

Figure 1:
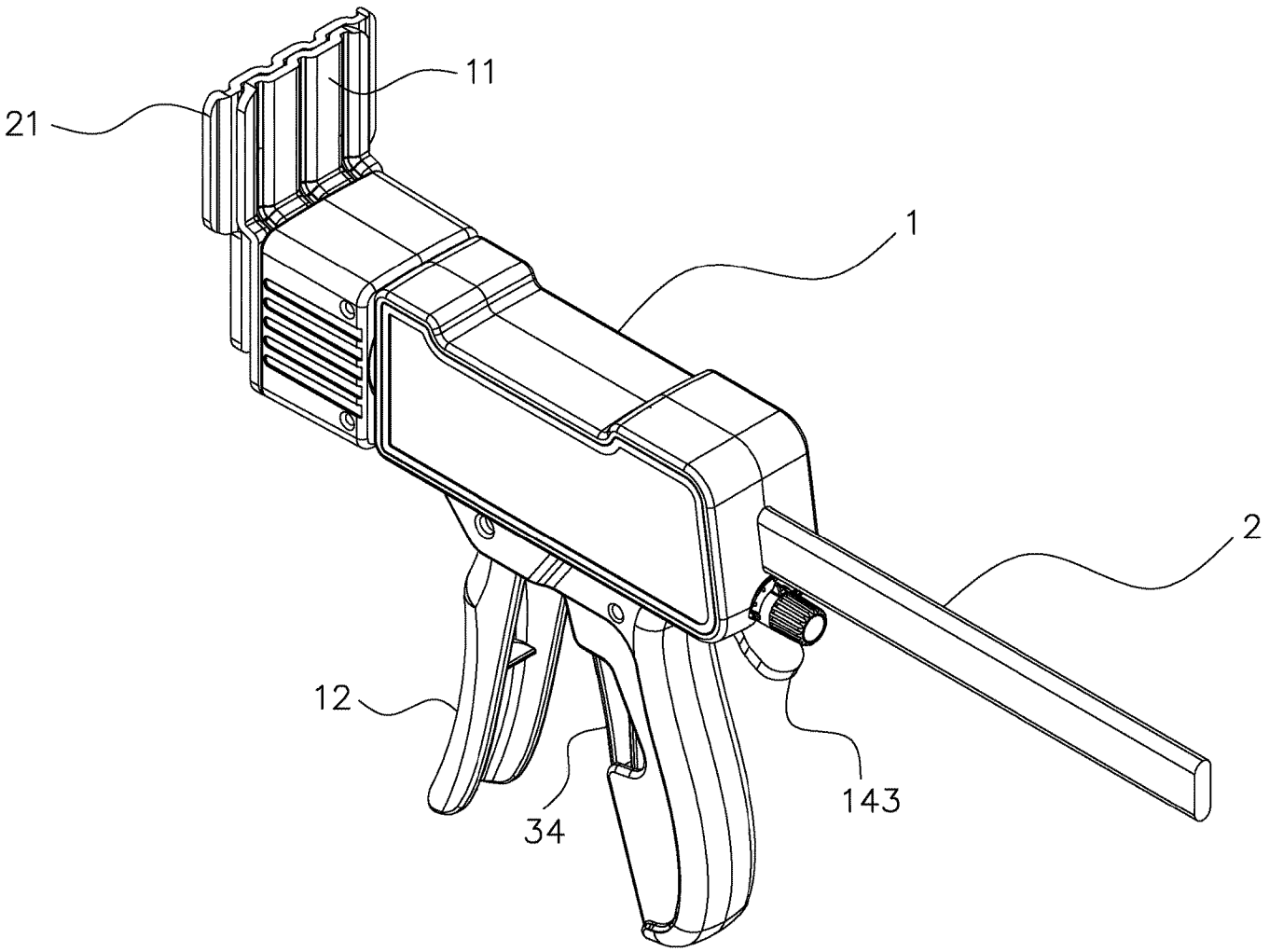
FIG. 1 is a perspective view showing the assembly of a lift jack according to a first embodiment of the present invention.
Figure 2:
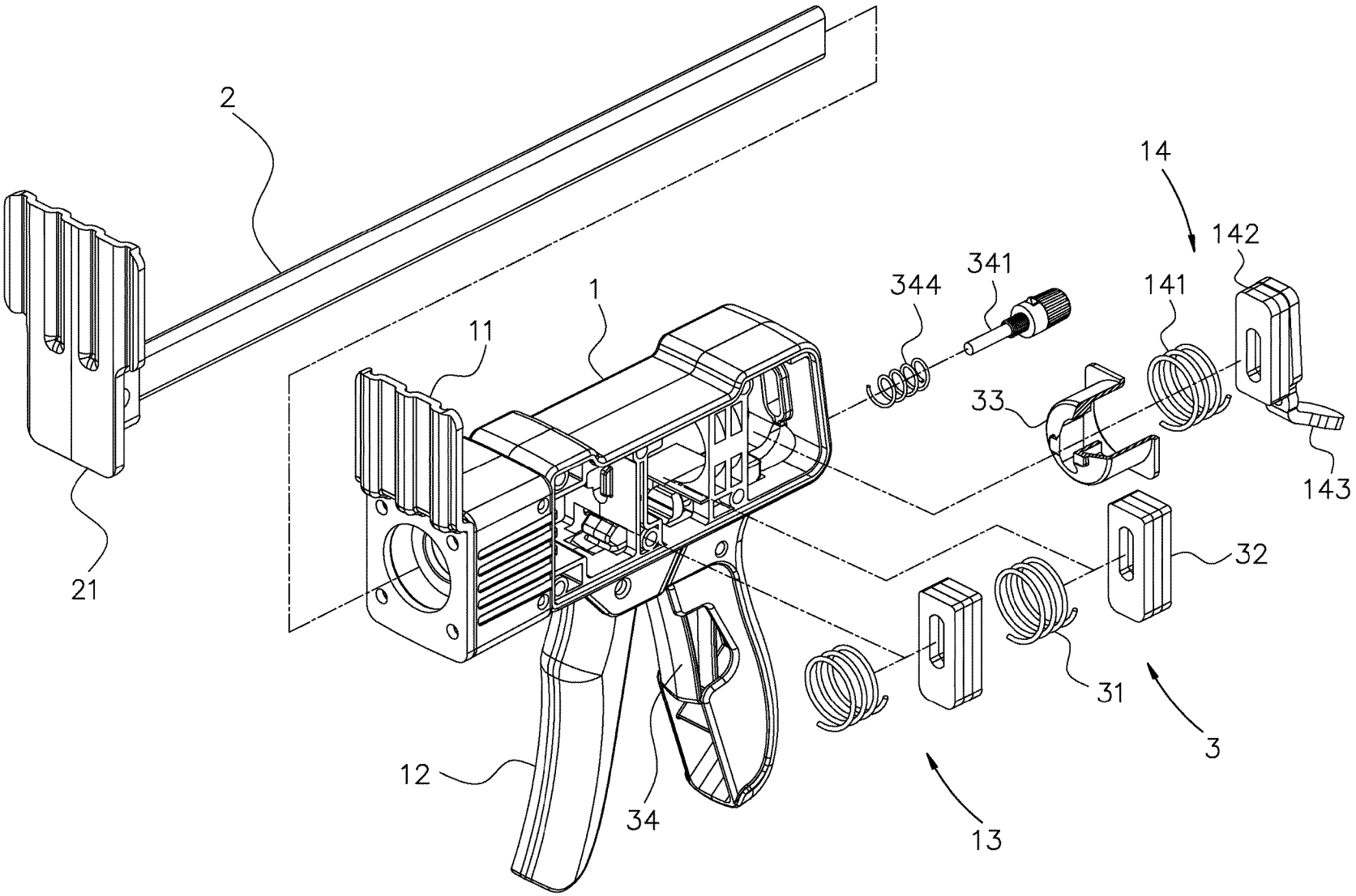
FIG. 2 is a perspective view showing the exploded components of the lift jack according to the first embodiment of the present invention.
Figure 3:
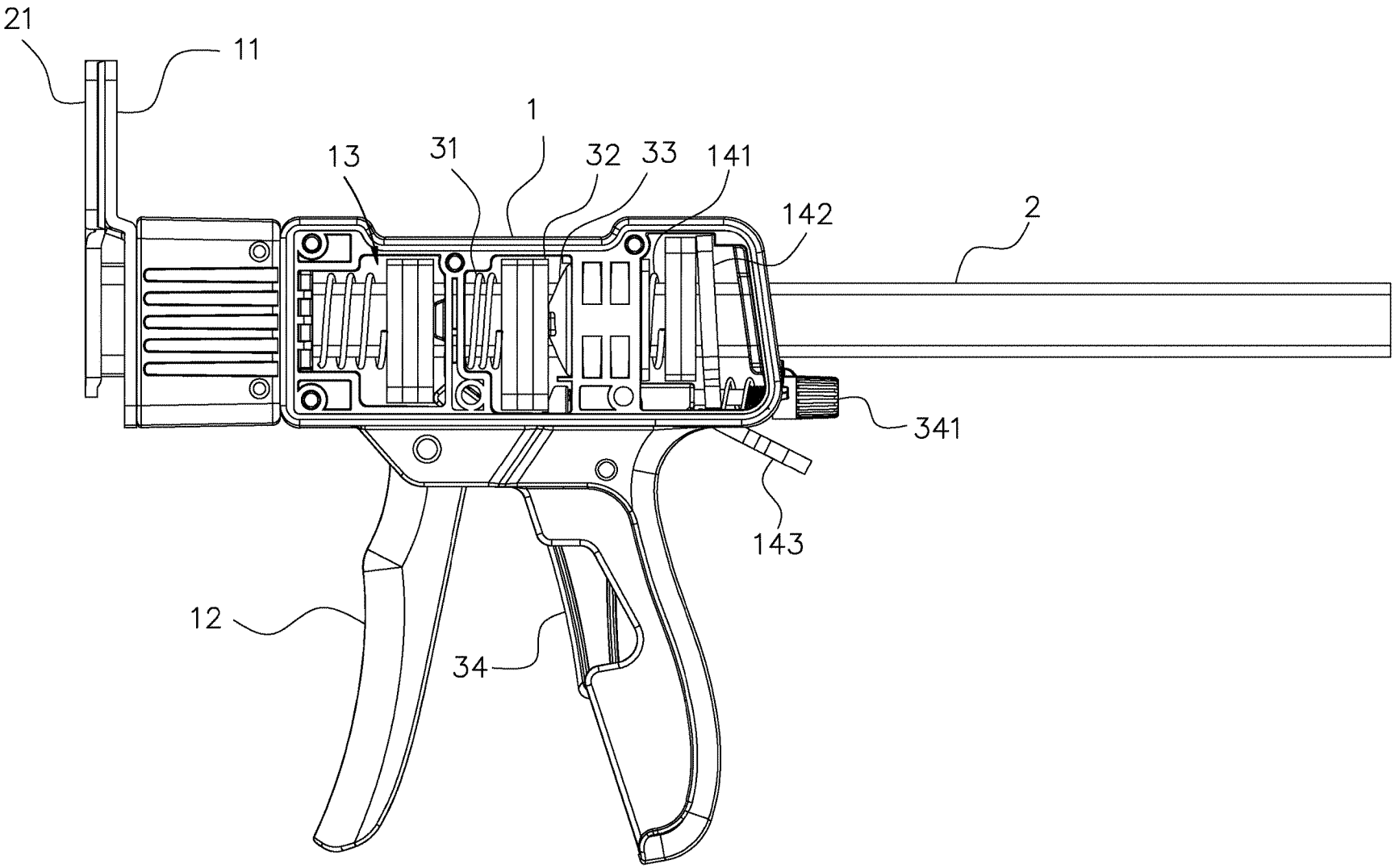
FIG. 3 is a cross-sectional plan view showing the operation of the lift jack according to the first embodiment of the present invention.

The present invention will be clearer from the following description when viewed together with the accompanying drawings, which show, for purpose of illustrations only, a preferred embodiment in accordance with the present invention.

With reference to FIGS. 1 to 6, a lift jack according to a preferred embodiment of the present invention is capable of lifting and descending an object gradually and slowly in a repeated pressing manner.

The lift jack comprises: a body 1, an actuation rod 2, and a slow descending device 3.

The body 1 includes a first support sheet 11 disposed on an end thereof, and the actuation rod 2 is movably inserted through the body 1, wherein the actuation rod 2 includes a second support sheet 21 mounted on an end thereof and corresponding to the first support sheet 11, and the body 1 further includes a drive grip 12 rotatably connected on a bottom thereof, a driven mechanism 13, comprising a spring 131 and fixing protrusions 132, received in the body 1 and controlled by the drive grip 12 to expand the first support sheet 11 from the second support sheet 21, such that the second support sheet 21 abuts against a ground, and the first support sheet 11 contacts with the object, thus lifting the object. The body 1 further including a limitation mechanism 14 accommodated therein and configured to fix the actuation rod 2 after the actuation rod 2 moves relative to the body 1. The limitation mechanism 14 has a first spring 141, multiple first fixing protrusions 142, and a release lever 143 extending from an end of the multiple first fixing protrusions 142 and configured to remove the actuation rod 2 relative to the body 1.

Figure 7:
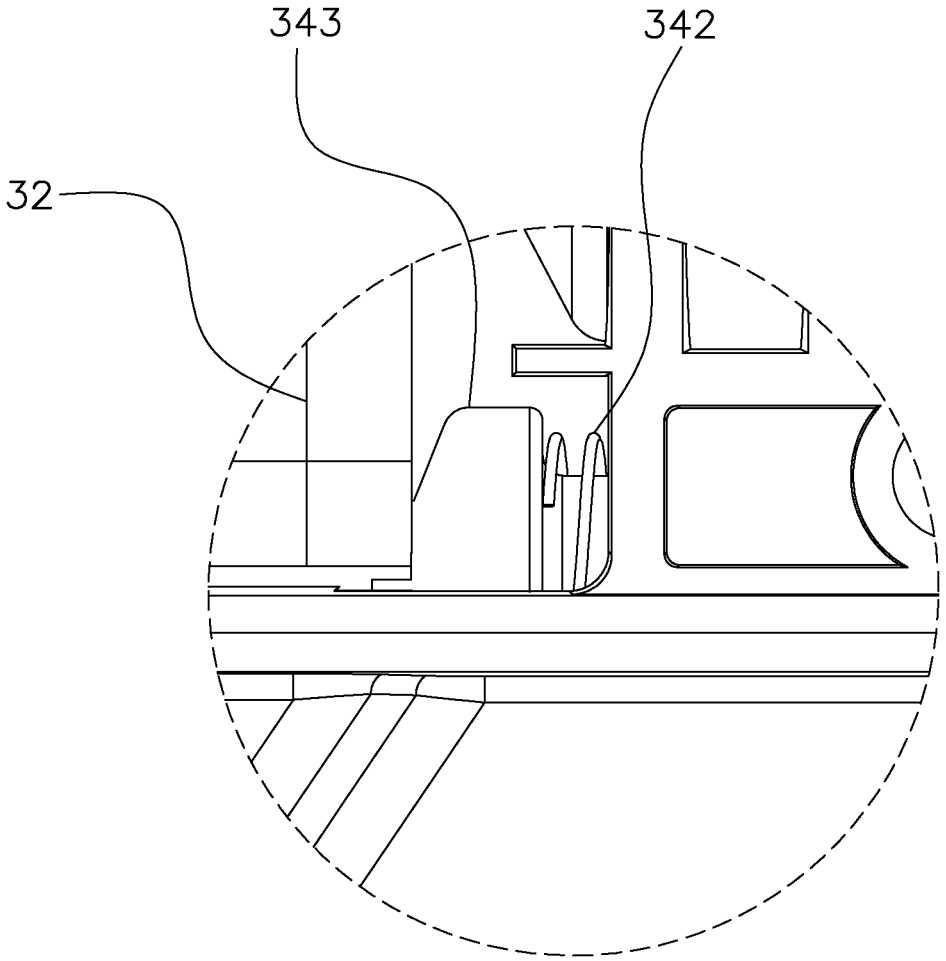
FIG. 7 is an amplified cross-sectional view of a portion A of FIG. 6.

The slow descending device 3 includes a second spring 31, multiple second fixing protrusions 32, a guide element 33, and a micro-adjustment handle 34 rotatably connected on the bottom of the body 1 adjacent to the drive grip 12, wherein the micro-adjustment handle 34 has a pull lever 341 which is inserted through and drives the release lever 143 after being pressed. The second spring 31 surrounds around the actuation rod 2, the multiple second fixing protrusions 32 accommodate the actuation rod 2 and are pushed by the second spring 31, and the actuation rod 2 is also inserted through the guide element 33, wherein a first end of the guide element 33 is pushed by the first spring 141 and a second end of the guide element abuts against the multiple fixing protrusions 32. The micro-adjustment handle 34 has a third spring 342 and a control lever 343 pushed by the third spring 342 and contacting with the multiple second fixing protrusions 32, as shown in FIG. 7.

Figure 4:
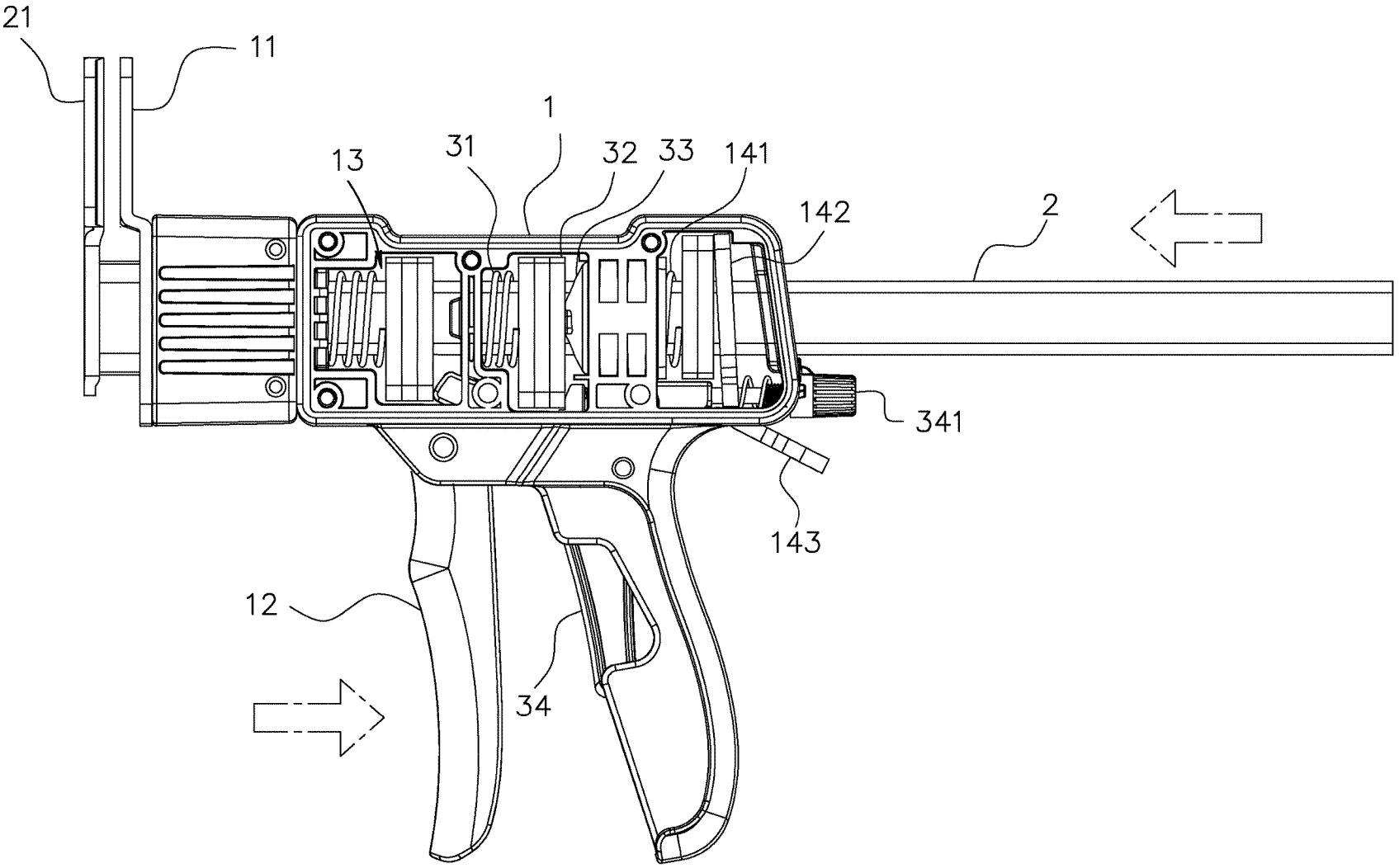
FIG. 4 is another cross-sectional plan view showing the operation of the lift jack according to the first embodiment of the present invention.
Figure 5:
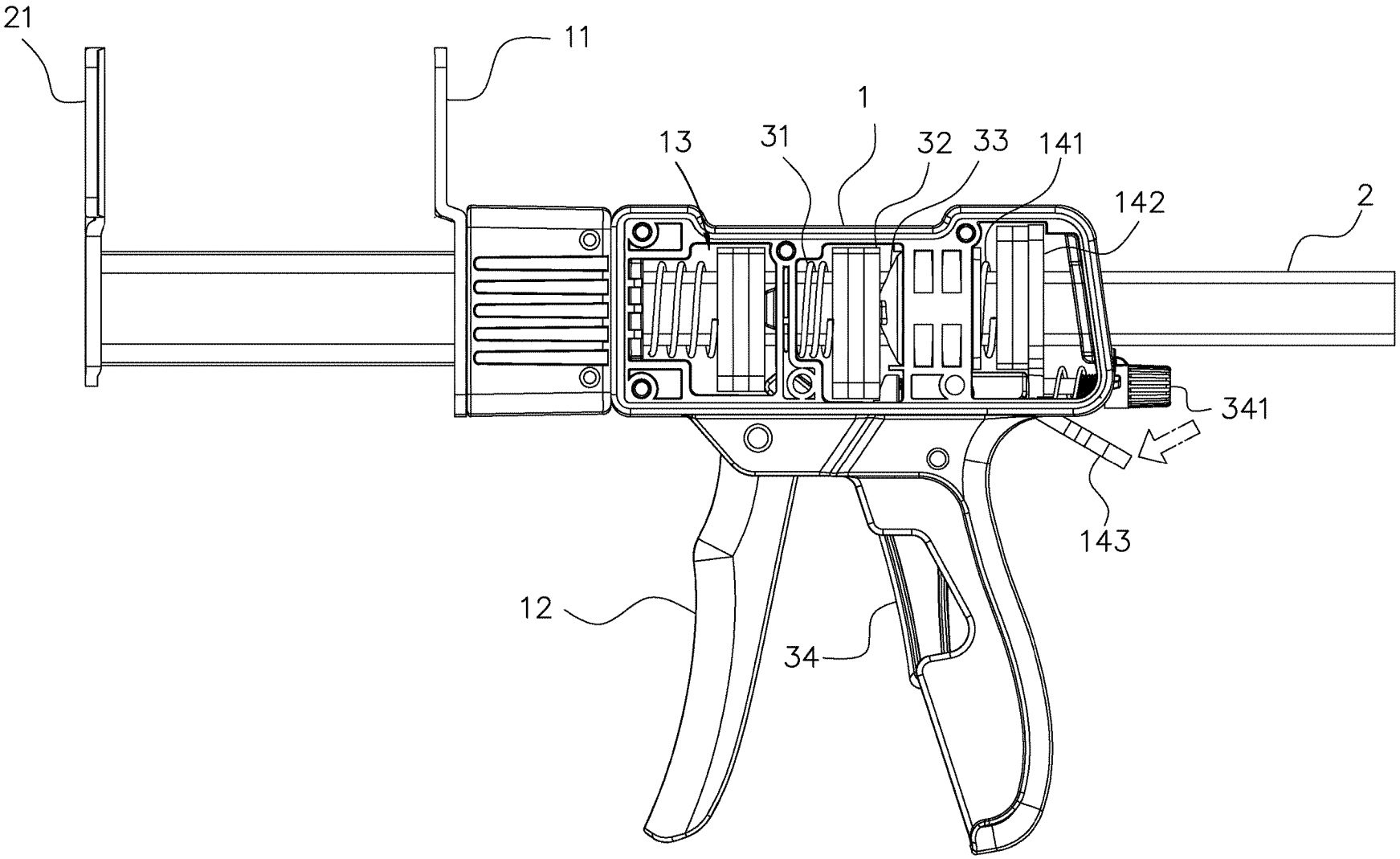
FIG. 5 is also another cross-sectional plan view showing the operation of the lift jack according to the first embodiment of the present invention.
Figure 6:
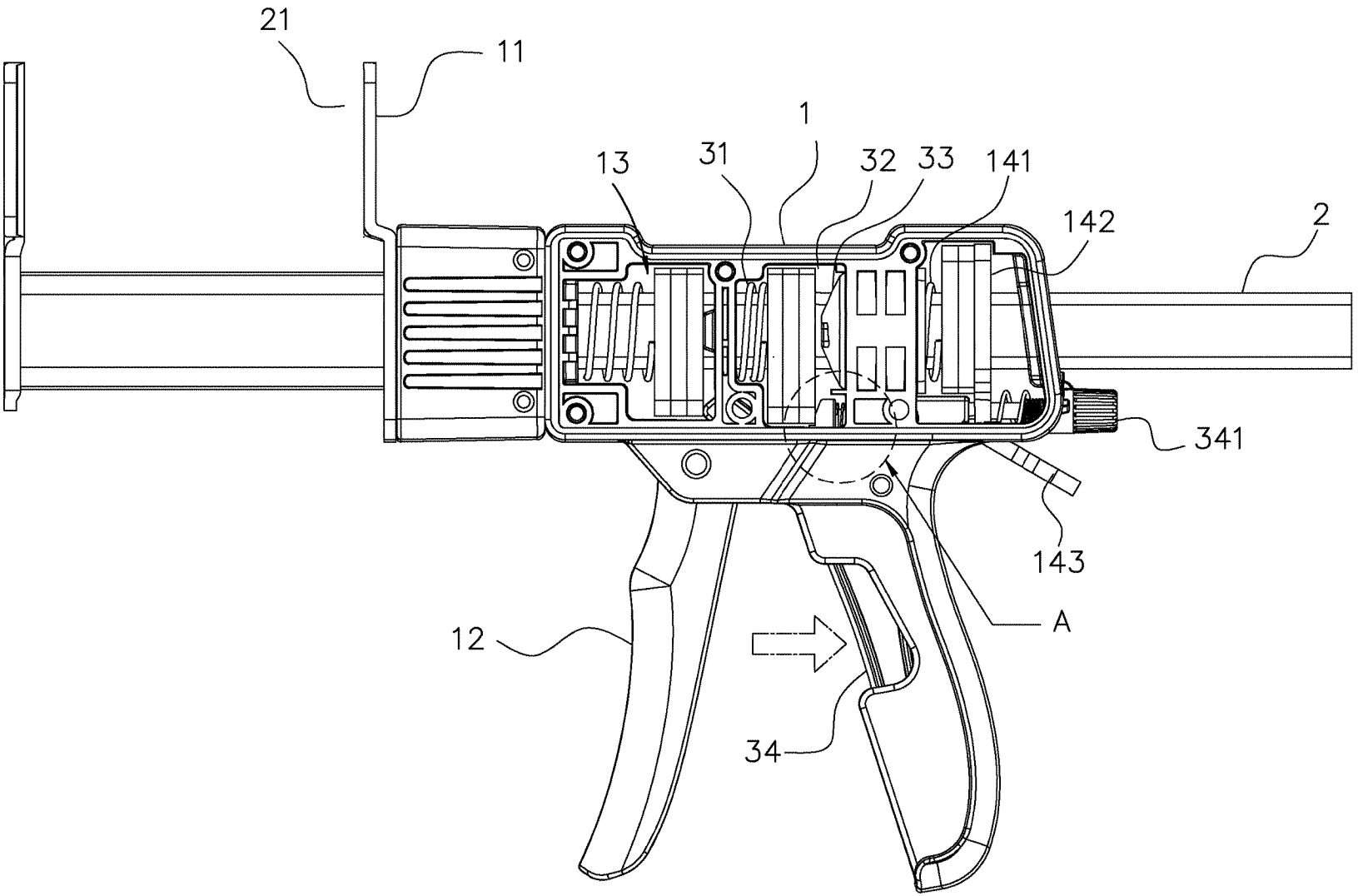
FIG. 6 is still another cross-sectional plan view showing the operation of the lift jack according to the first embodiment of the present invention.

Thereby, the drive grip 12 is pressed repeatedly to actuate the driven mechanism 13 to expend the first support sheet 11 and the second support sheet 21, thus lifting the object, as illustrated in FIG. 4. When pressing the release lever 143, the multiple fixing protrusions 142 remove from the actuation rod 2 so that the first support sheet 11 and the second sheet 21 retract to each other, as shown in FIG. 5. As desiring to adjust the first support sheet 11 and the second support sheet 21 slowly, the micro-adjustment handle 34 is pressed so that the pull lever 341 pulls the release lever 143 so that the multiple fixing protrusions 142 remove from the actuation rod 2. In the meantime, the micro-adjustment handle 34 presses the third spring 342 and pushes the control lever 343 to abut against the multiple second fixing protrusions 32 so that the multiple second fixing protrusions 32 engage with the actuation rod 2, the multiple first fixing protrusions 142 detach from the actuation rod 2, and the multiple second fixing protrusions 32 fix the actuation rod 2. Meanwhile, the first support sheet 11 and the second support 21 do not descend slowly, as shown in FIG. 6. When releasing the micro-adjustment handle 34, the multiple second fixing protrusions 32 remove from the actuation rod 2, because the third spring 342 of the control lever 343 does not support the first support sheet 11 and the second support sheet 21, and the first support sheet 11 and the second support sheet 21 retract to each other in a short distance.

The pull lever 341 has a threaded portion configured to adjustably drive the micro-adjustment handle 34, and a fourth spring 344 is defined between the pull lever 341 and the release lever 143, such that the pull lever 341 is rotated to adjustably control the fourth spring 344 to force the release lever 143 tightly or loosely, thus adjusting a forced strength of the release lever 143 forced by the pull lever 341 so as to adjust the distance between the first support sheet 11 and the second support sheet 21.

Figure 8:
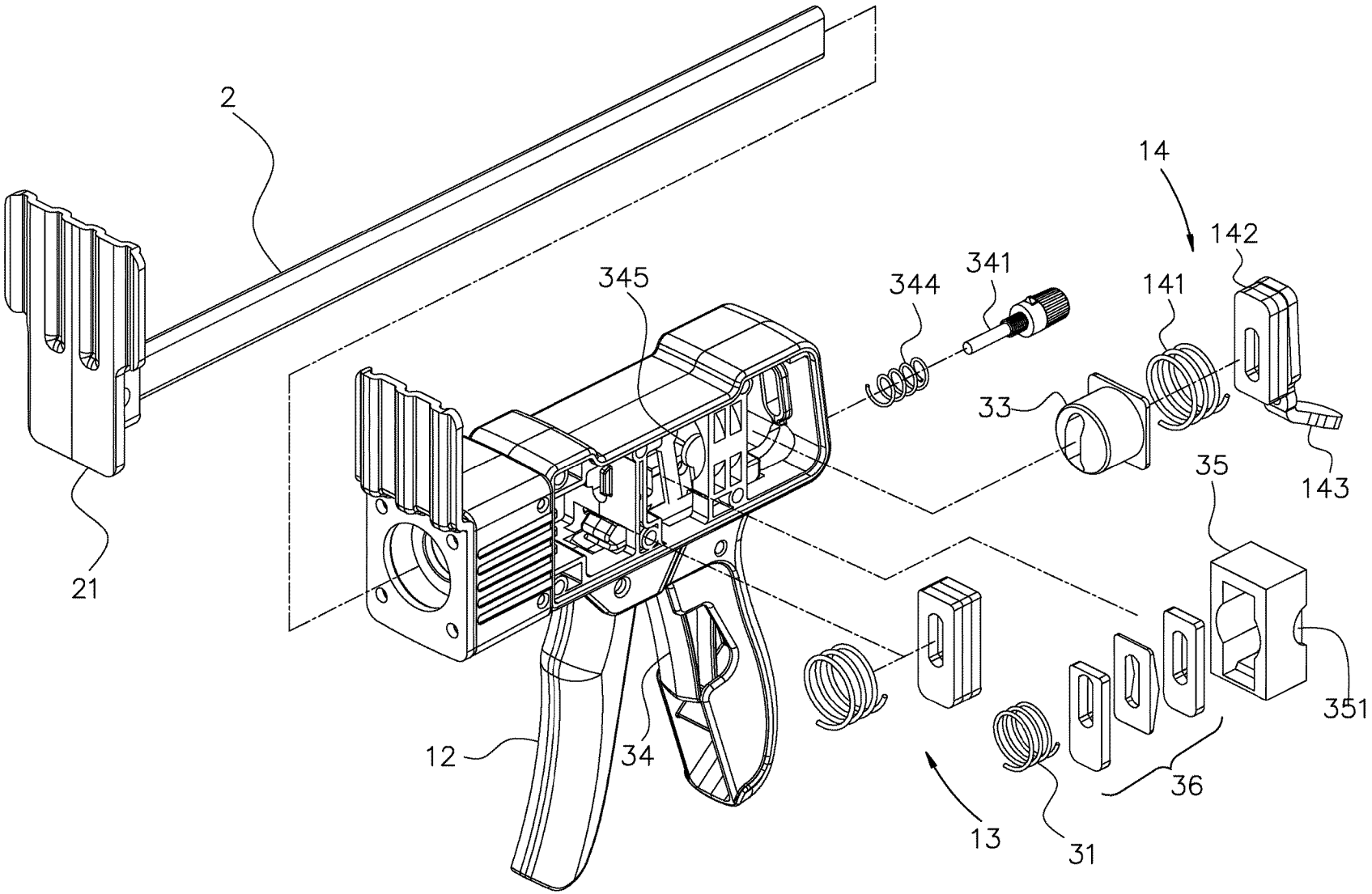
FIG. 8 is a perspective view showing the exploded components of a lift jack according to a second embodiment of the present invention.
Figure 9:
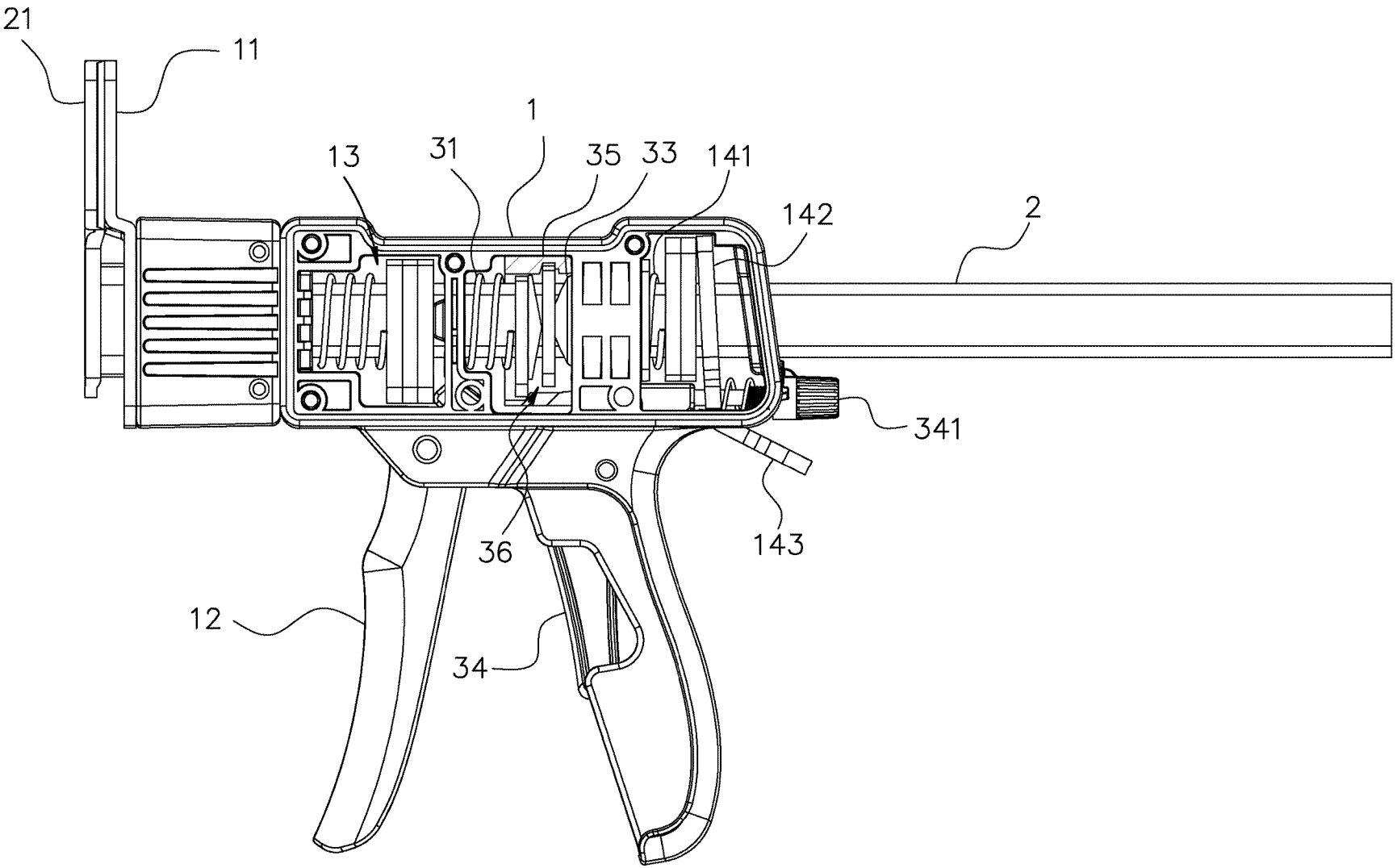
FIG. 9 is a cross-sectional plan view showing the assembly of the lift jack according to the second embodiment of the present invention.

Referring to FIGS. 8 and 9, in a second embodiment, the slow descending device 3 includes a slide seat 35 received in the body 1, and multiple second fixing protrusions 36 are accommodated in the slide seat 35, wherein the slide seat 35 has two arcuate grooves 351 defined on two sides of the slide seat 35, and the micro-adjustment handle 34 has two circular pushing posts 345 corresponding to the two arcuate grooves 351, such that when the micro-adjustment handle 34 is pressed, the slide seat 35 is driven by the micro-adjustment handle 34 to push the multiple fixing protrusions 36.

Thereby, the lift jack of the present invention is capable of expanding outward, and the first support sheet and the second sheet are adjustable to retract to each other by pressing the drive grip repeatedly.

While various embodiments in accordance with the present invention have been shown and described, it is clear to those skilled in the art that further embodiments may be made without departing from the scope of the present invention.

What is claimed is:

1. A lift jack comprising:

a body, an actuation rod, and a slow descending device;

wherein the body includes a first support sheet disposed on an end thereof, and the actuation rod is movably inserted through the body and includes a second support sheet mounted on an end thereof and corresponding to the first support sheet, wherein the body further includes a drive grip rotatably connected on a bottom thereof, a driven mechanism received in the body and controlled by the drive grip to expand the first support sheet from the second support sheet, wherein the body further includes a limitation mechanism accommodated therein and configured to fix the actuation rod after the actuation rod moves relative to the body;

wherein the limitation mechanism has a first spring, multiple first fixing protrusions, and a release lever extending from an end of the multiple first fixing protrusions and configured to release the actuation rod relative to the body;

wherein the slow descending device includes a second spring, multiple second fixing protrusions, a guide element, and an adjustment handle rotatably connected on the bottom of the body adjacent to the drive grip, wherein the adjustment handle has a pull lever which is inserted through and drives the release lever after being pressed, and the second spring is disposed around the actuation rod, the multiple second fixing protrusions accommodate the actuation rod and are pushed by the second spring, and the actuation rod is also inserted through the guide element, wherein a first end of the guide element is pushed by the first spring and a second end of the guide element abuts against the multiple second fixing protrusions, and the adjustment handle has a third spring and a control lever pushed by the third spring and contacting with the multiple second fixing protrusions.

2. The lift jack as claimed in claim 1, further comprising a fourth spring engaged with the pull lever and configured to bias the release lever.

* * * * *